US007955023B2

(12) United States Patent
Sung et al.

(10) Patent No.: US 7,955,023 B2
(45) Date of Patent: Jun. 7, 2011

(54) SLIP BASE STRUCTURE WITH CLIP DEVICE

(75) Inventors: Jung Gon Sung, Goyang-si (KR); Duk Geun Yun, Goyang-si (KR); Man Gi Ko, Gongju-si (KR); Kee Dong Kim, Gongju-si (KR)

(73) Assignees: Korea Institute of Construction Technology, Goyang-si (KR); Kongju National University Industry-University Cooperation Foundation, Gongju-si (KR)

( * ) Notice: Subject to any disclaimer, the term of this patent is extended or adjusted under 35 U.S.C. 154(b) by 92 days.

(21) Appl. No.: 12/464,466

(22) Filed: May 12, 2009

(65) Prior Publication Data

US 2010/0254760 A1 Oct. 7, 2010

(30) Foreign Application Priority Data

Apr. 6, 2009 (KR) ..... 10-2009-0029417

(51) Int. Cl.
*E01F 9/011* (2006.01)

(52) U.S. Cl. ..... 404/10; 404/9; 40/612

(58) Field of Classification Search ..... 40/606.01, 40/606.14, 612; 404/9, 10; 49/49
See application file for complete search history.

(56) References Cited

U.S. PATENT DOCUMENTS

| | | | | |
|---|---|---|---|---|
| 3,572,223 | A * | 3/1971 | Vierregger | 52/296 |
| 4,923,319 | A * | 5/1990 | Dent | 403/2 |
| 4,926,592 | A * | 5/1990 | Nehls | 52/98 |
| 5,481,835 | A * | 1/1996 | Bloom | 52/98 |
| 5,855,443 | A * | 1/1999 | Faller et al. | 403/2 |
| 6,019,543 | A * | 2/2000 | Junker | 404/10 |
| 6,422,783 | B1 * | 7/2002 | Jordan | 404/9 |
| 6,540,196 | B1 * | 4/2003 | Ellsworth | 248/548 |
| 7,056,056 | B2 * | 6/2006 | Wiegand et al. | 404/10 |

* cited by examiner

*Primary Examiner* — Gary S Hartmann
(74) *Attorney, Agent, or Firm* — John K. Park; Park Law Firm

(57) ABSTRACT

The present invention relates to a structure for supporting a road support including: a base plate fixedly disposed on ground in such a manner as to be spaced apart by a predetermined distance from the surface of ground; a slip plate slidably disposed on the top surface of the base plate; a coupling body protruded upwardly from the center portion of the top surface of the slip plate in such a manner as to be insertedly coupled to the inner lower end portion of a support body; and a plurality of clips each having an approximately '⊏' or 'C'-like shape so as to receive the edges of the base plate and the slip plate thereinto, each of the plurality of clips having a fixing bolt fastened to a female screw passed through the top end portion thereof so as to compressedly support the top surface of the slip plate.

4 Claims, 9 Drawing Sheets

SECT A-A

SLIP BASE STRUCTURE WITH CLIP DEVICE

BACKGROUND OF THE INVENTION

1. Field of the Invention

The present invention relates to a structure for supporting a road support that is configured to allow a slip plate to separably slip from a base plate when a vehicle collides against the road support, thereby preventing a support body from being damaged, and more particularly, to a structure for supporting a road support that is configured to fasten a slip plate coupled integrally to a support body to a base plate disposed under the slip plate by means of a plurality of clips, such that the slip plate separably slips from the base plate when a vehicle collides against the road support, thereby minimizing an amount of impact between the vehicle and the road support, ensuring the safety of the passengers in the vehicle, and preventing or reducing the damage of the support body.

2. Background of the Related Art

Desirably, no installation for other structures except guide rails along the side of road is allowed so as to provide the safety of vehicles, but there is necessary equipment such as road signs, illuminating facilities, signal lamps, emergency telephones, electric poles, and the like, according to the functional or topographic conditions of the side of road. If a vehicle is deviated from the lane while the driver is driving in the state of dozing off at the wheel, under the influence, and in the state of being poor at driving, and alternatively, if the surface of road is slippery because of the snow, rain or ice covered thereon, the vehicle may collide against the equipment fixed along the side of road. Accordingly, there is a need for the safety projects for the fixed equipment on the side of road according to specific conditions for road, upon making the design for the road.

When a vehicle collides against a conventional small-sized road support, the road support is bent to fall toward the vehicle, so that the front window of the vehicle is broken into pieces to cause serious damages (that is, the injuries of the passengers in the vehicle) therefrom. Especially, if the road support has relatively high strength, the road support is bent and rather inserted into the inside of the vehicle than falling toward the vehicle, thereby causing a serious damage to the vehicle and failing to provide the safety of the passengers in the vehicle. So as to solve the above-mentioned problems, thus, if predetermined impact is applied to the road support, there is a need for separating the road support fixed on ground in such a manner as to be directed toward the advancing direction of the vehicle.

In other words, there is a definite need for a novel structure for supporting a road support wherein at normal cases the road support ensures its structural safety against wind load, but if vehicle collision occurs to apply a predetermined level of impact load to the road support, the lower end portion of the road support is separated from the ground, while absorbing a substantially quantity of the impact load thereto, thereby providing the safety of the passengers in the vehicle and at the same time minimizing the damages of the vehicle and the road support.

As shown in FIGS. 1A and 1B, there is a conventional structure for supporting a road support wherein a slip plate 300 to which a support body 100 is integrally coupled is placed on a base plate 200 fixed on ground, and a plurality of incised grooves 11 are formed along the edges of the slip plate 300 and the base plate 200, such that the slip plate 300 and the base plate 200 are fastened to each other by means of the insertion of bolts and nuts into the incised grooves 11.

In this manner, the slip plate 300 and the base plate 200 are fastened to each other just by means of the fastening force caused by the bolts and nuts, but even though the bolts and nuts are rigidly fastened, they may be loose while the road support is being exposed to wind pressure for a long period of time. To the contrary, if the bolts and nuts are excessively fastened, the slip plate 300 may be not separated from the base plate 200 when the vehicle collides against the road support.

Accordingly, there is a need for the development of a novel structure for supporting a road support which can maintain a stable coupling state between the slip plate and the base plate in normal states and can separate the slip plate from the base plate in a state where external impact over a predetermined level is applied to the road support.

SUMMARY OF THE INVENTION

Accordingly, the present invention has been made in view of the above-mentioned problems occurring in the prior art, and it is an object of the present invention to provide a structure for supporting a road support that maintains a stable coupling state between a slip plate to which a support body is coupled integrally and a base plate fixed on ground in normal states during which wind load is applied, while separating the slip plate from the base plate in a state where external impact over a predetermined level caused by the collision against a vehicle is applied to the road support.

It is another object of the present invention to provide a structure for supporting a road support that provides a means for adjusting the inclination of a slip plate so as to erect a support body.

It is yet another object of the present invention to provide a structure for supporting a road support that effectively absorbs impact load applied thereto, thereby minimizing the damages of a vehicle and a driver and at the same time reducing the damage of a support body to increase the recycling effect of the support body.

To accomplish the above objects, according to the present invention, there is provided a structure for supporting a road support, the structure including: a base plate fixedly disposed on ground in such a manner as to be spaced apart by a predetermined distance from the surface of the ground; a slip plate slidably disposed on the top surface of the base plate; a coupling body protruded upwardly from the center portion of the top surface of the slip plate in such a manner as to be insertedly coupled to the inner lower end portion of a support body; and a plurality of clips having an approximately '⊏'-like shape so as to receive the edges of the base plate and the slip plate thereinto, each of the plurality of clips having a fixing bolt fastened to a female screw passed through the top end portion thereof so as to compressedly support the top surface of the slip plate.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, an explanation on a structure for supporting a road support according to the preferred embodiments of the present invention will be in detail given with reference to the attached drawings.

Figure 1A:
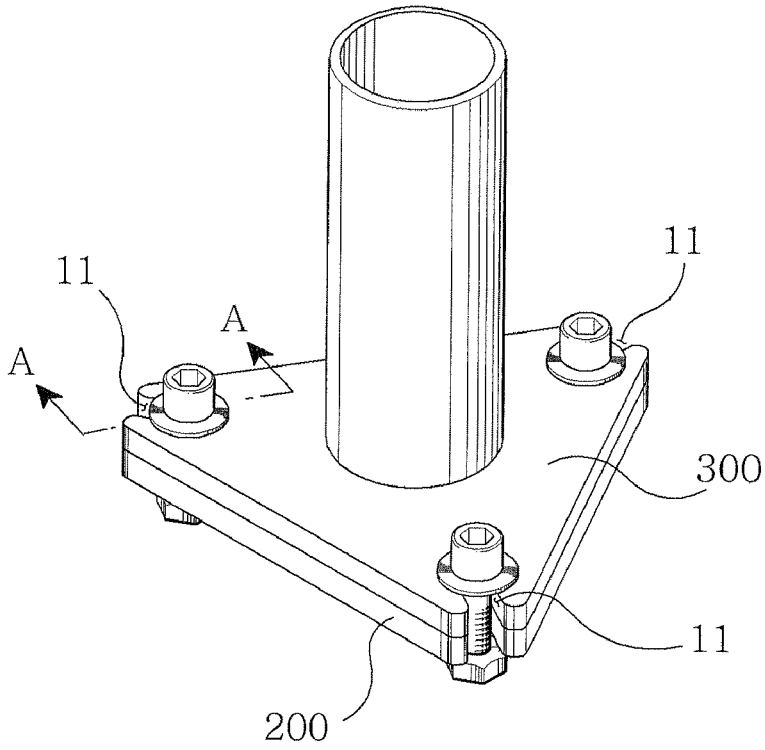
FIGS. 1A and 1B are perspective and sectional views showing a conventional coupling structure between a slip plate and a base plate.
Figure 1B:
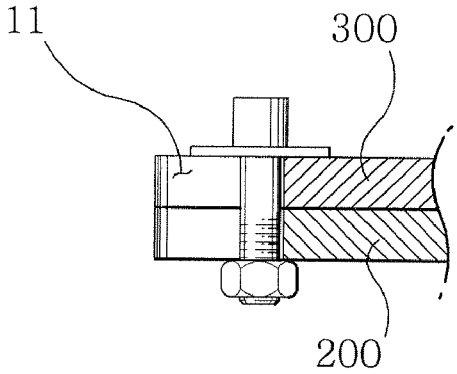
Figure 2:
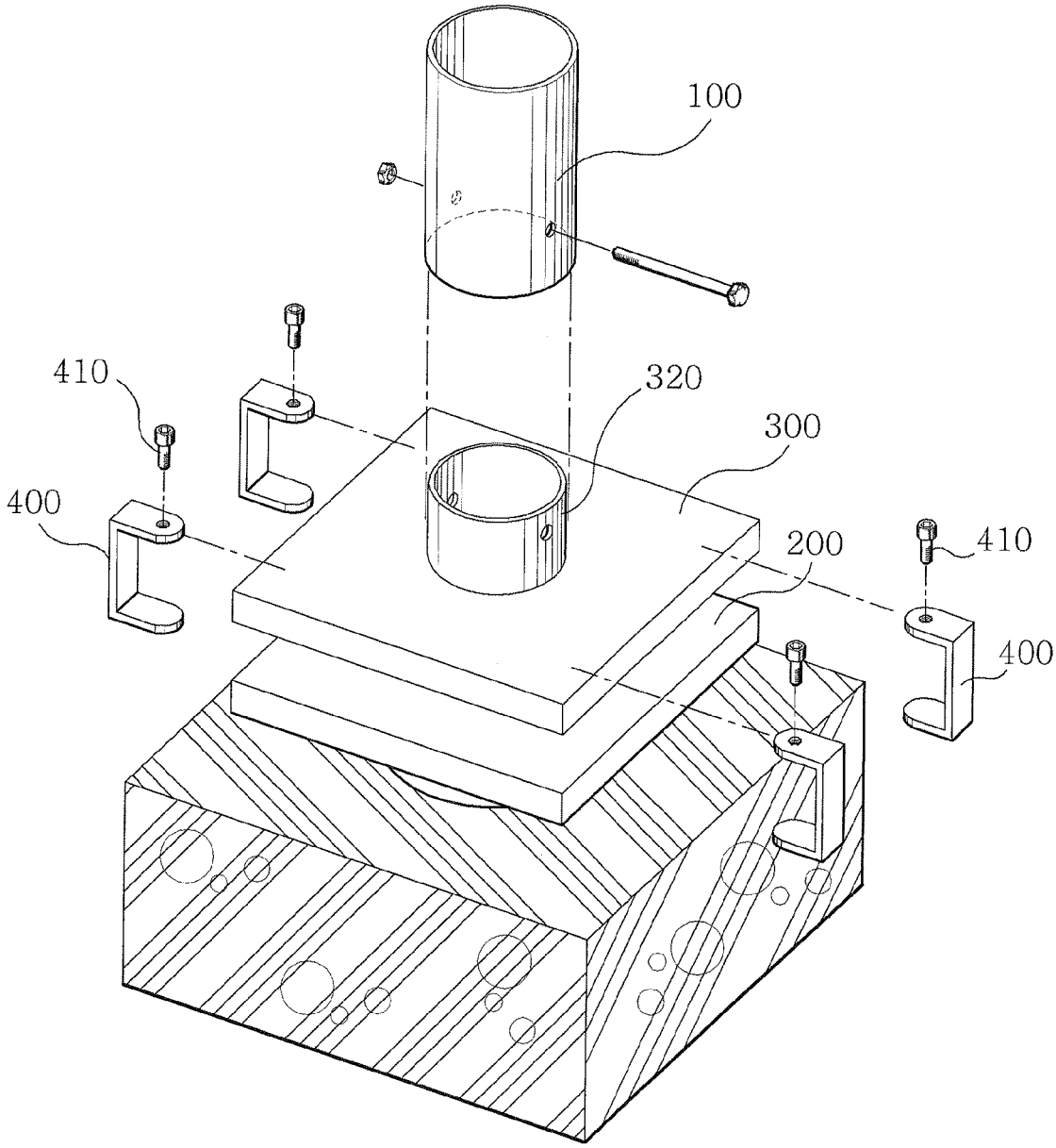
FIG. 2 is an exploded perspective view showing a structure for supporting a road support according to a first embodiment of the present invention.
Figure 3:
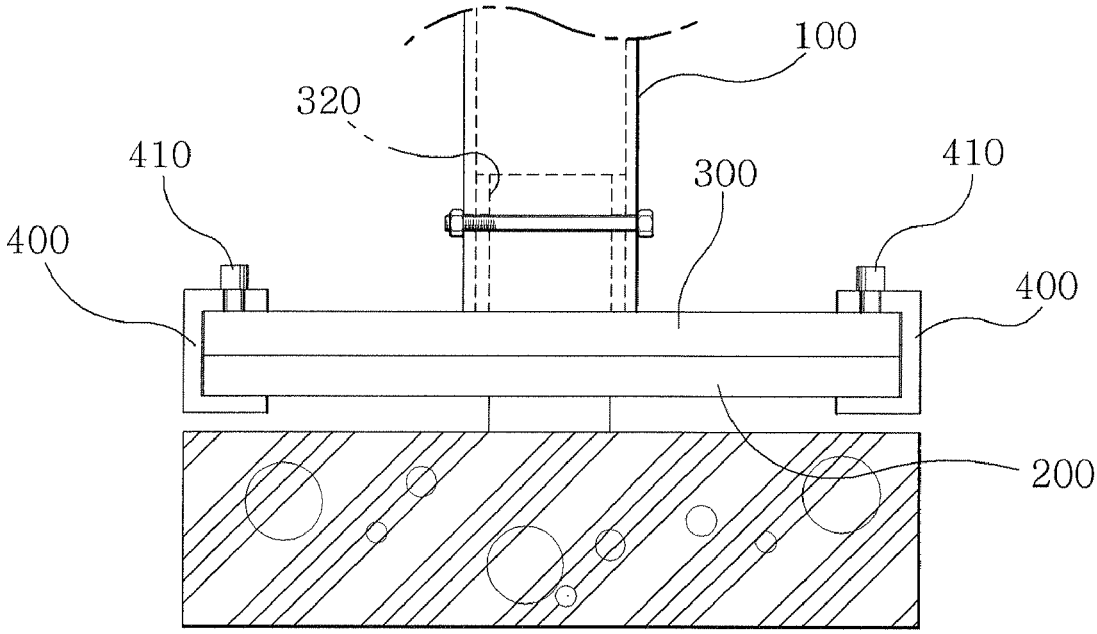
FIG. 3 is a sectional view showing the structure for supporting a road support in FIG. 2.
Figure 4:
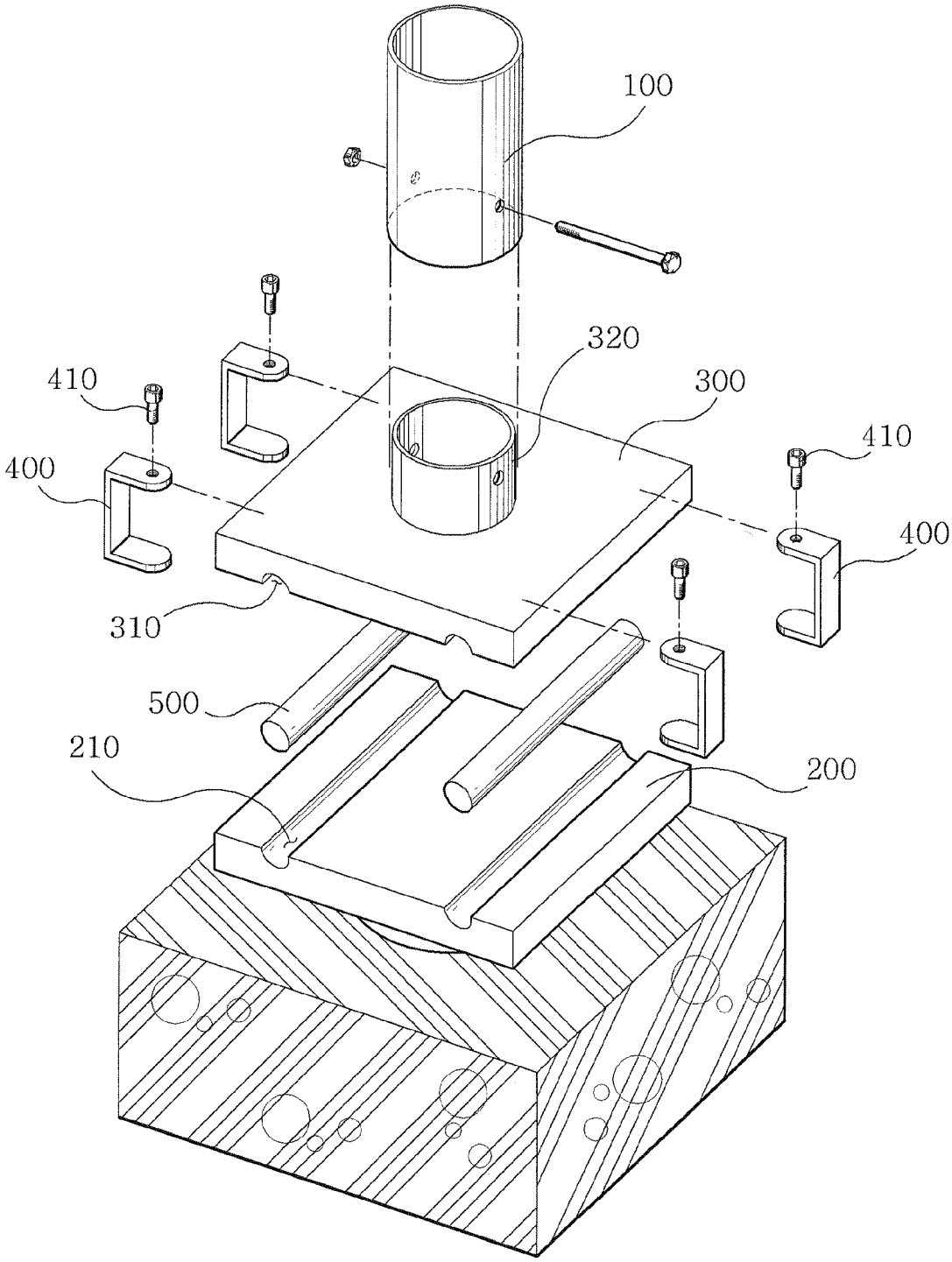
FIG. 4 is an exploded perspective view showing a structure for supporting a road support according to a second embodiment of the present invention.
Figure 5:
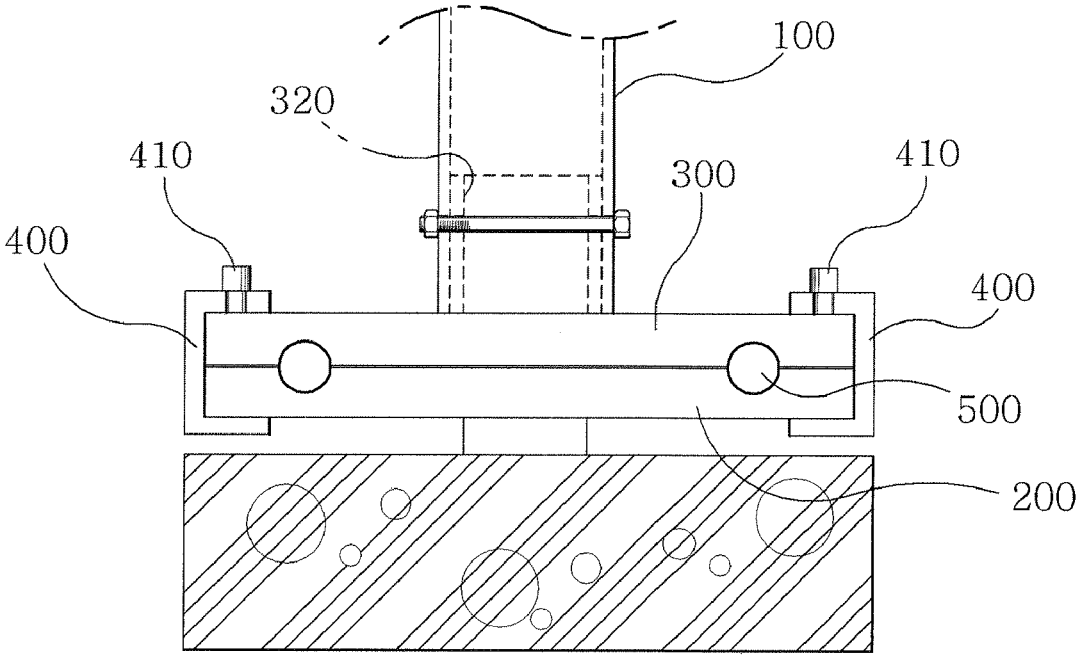
FIG. 5 is a sectional view showing the structure for supporting a road support in FIG. 4.
Figure 6:
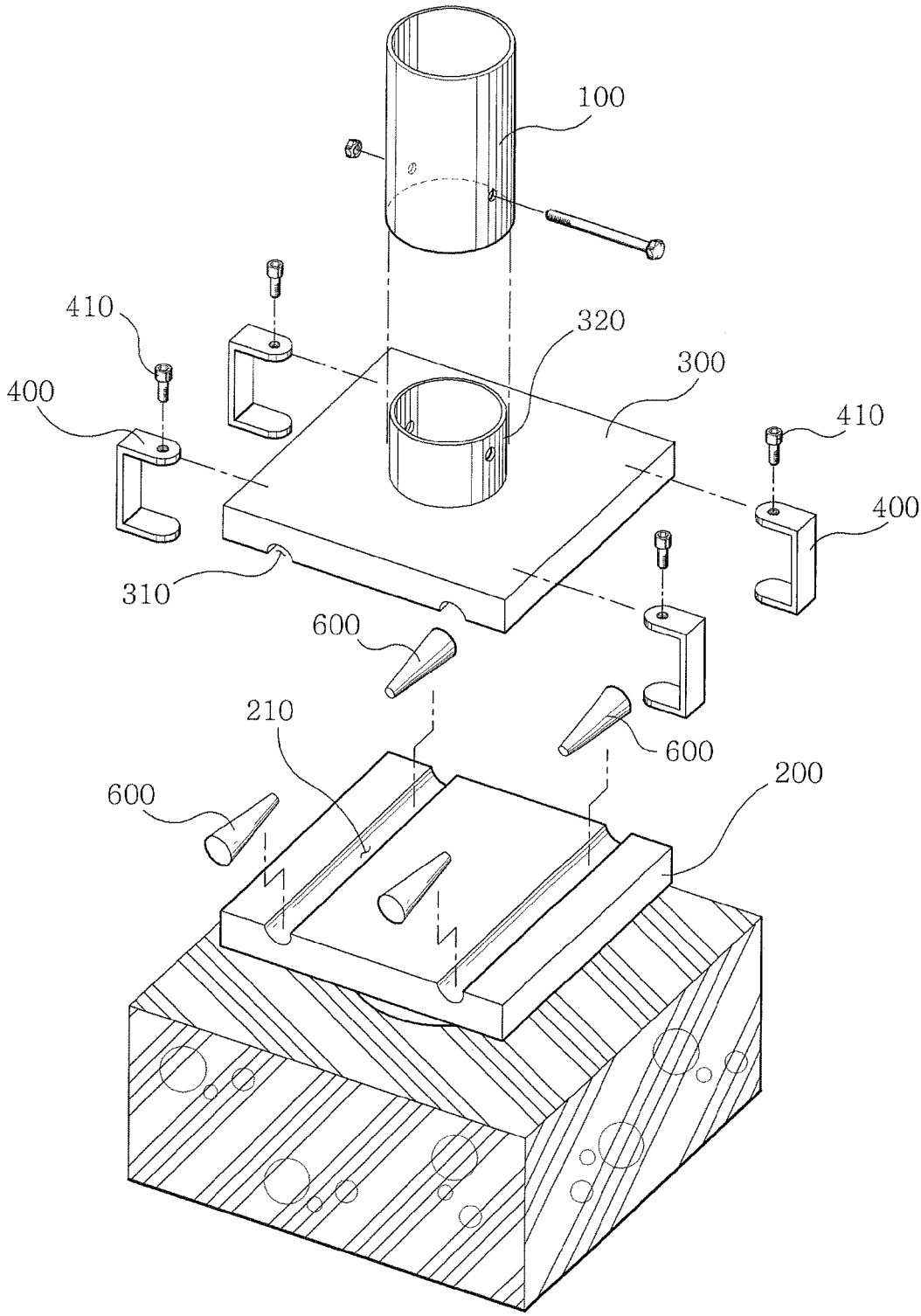
FIG. 6 is an exploded perspective view showing a structure for supporting a road support according to a third embodiment of the present invention.
Figure 7A:
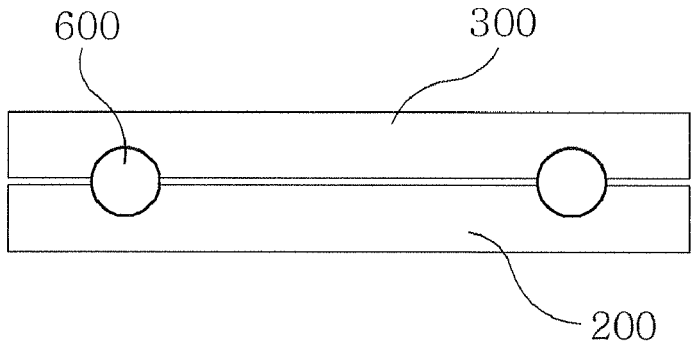
FIGS. 7A and 7B are side and sectional views showing the structure for supporting a road support in FIG. 6.
Figure 7B:
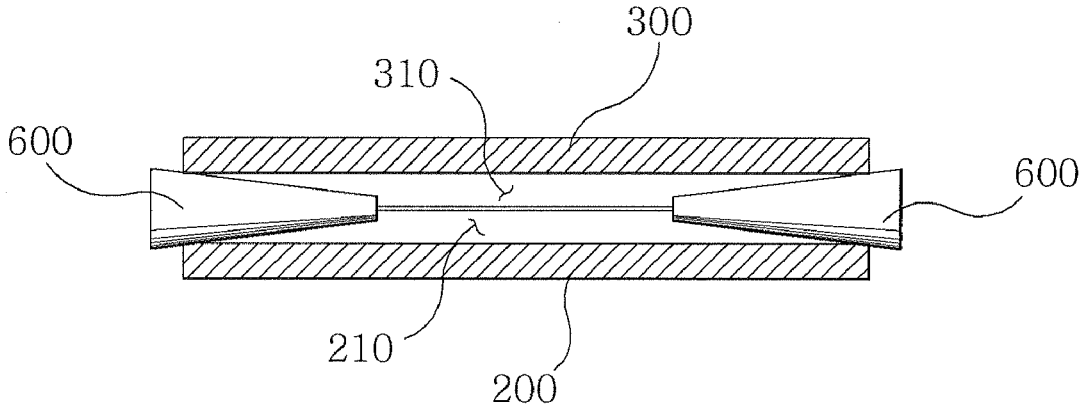

FIGS. 2 and 3 show a structure for supporting a road support according to a first embodiment of the present invention, FIGS. 4 and 5 show a structure for supporting a road support according to a second embodiment of the present invention, and FIGS. 6, 7A and 7B show a structure for supporting a road support according to a third embodiment of the present invention.

According to the first embodiment of the present invention, there are no lower roller-receiving grooves 210, upper roller-receiving grooves 310, slip rollers 500 received between the lower roller-receiving grooves 210 and the upper roller-receiving grooves 310, and taper rollers 600. According to the second embodiment of the present invention, there are the lower roller-receiving grooves 210, the upper roller-receiving grooves 310, and the slip rollers 500. According to the third embodiment of the present invention, there are the lower roller-receiving grooves 210, the upper roller-receiving grooves 310, and the taper rollers 600.

According to the first embodiment of the present invention, as shown in FIGS. 2 and 3, the structure for supporting a road support includes a base plate 200, a slip plate 300, a coupling body 320, a plurality of clips 400, and a plurality of fixing bolts 410.

The base plate 200 is fixedly disposed on ground in such a manner as to be spaced apart by a predetermined distance from the surface of the ground, while serving to support the slip plate 300.

Desirably, the base plate 200 has the same plane shape as the slip plate 300.

Figure 9A:
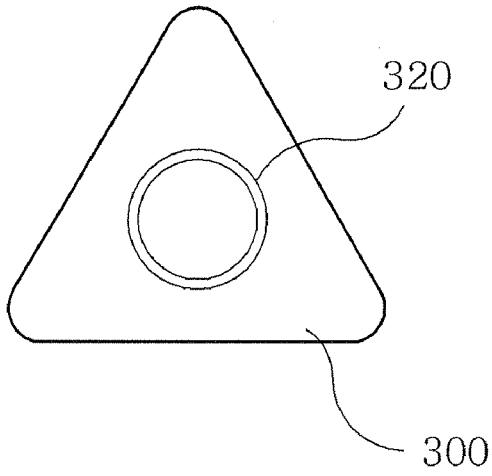
FIGS. 9A, 9B and 9C are top views showing a slip plate.
Figure 9B:
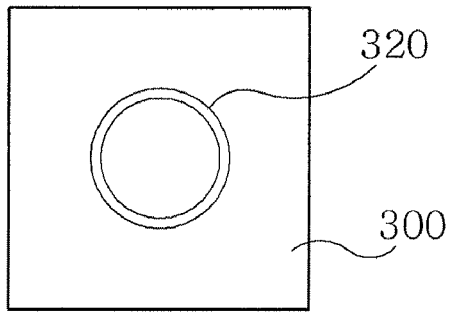
Figure 9C:
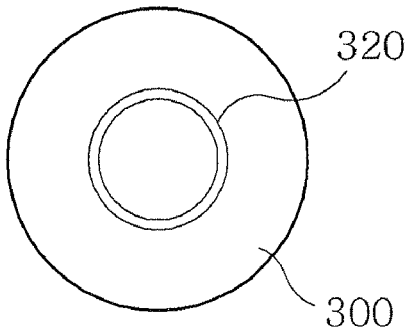

As shown in FIGS. 9A, 9B and 9C, the slip plate 300 has a variety of shapes such as triangle, square, round and the like, but of course, the slip plate 300 may have other shapes such as oval, diamond, trapezium and the like, which are not suggested in the drawing.

The coupling body 320 is protruded upwardly from the center portion of the top surface of the slip plate 300 in such a manner as to be insertedly coupled to the lower end portion of a support body 100. As shown in FIG. 2, if the diameter of the coupling body 320 is relatively small, the coupling body 320 is insertedly fit along the inner lower end periphery of the support body 100, and alternatively, if the diameter of the coupling body 320 is relatively large, the inner lower end periphery of the support body 100 is insertedly fit along the inner periphery of the coupling body 320.

It is not necessary that the support body 100 and the coupling body 320 have a round section, and therefore, they have various sectional shapes.

Furthermore, the support body 100 has a tube-like shape or a shape of H-beam. If the support body 100 has the shape of H-beam, the coupling body 320 desirably takes a shape of a square tube into which the support body 100 having the shape of H-beam is inserted.

As shown in FIG. 2, the lower end periphery of the support body 100 and the coupling body 320, which are insertedly coupled to each other, are fixed by means of a bolt and a nut passed through the support body 100 and the coupling body 320. The fixing method is not limited to as suggested in FIG. 2. That is, the bolt passed through the support body 100 may be fastened to a female screw provided on the coupling body 320, and alternatively, the support body 100 and the coupling body 320 may be fixedly coupled to each other by means of a pin.

The plurality of clips 400 has an approximately '⊏'-like or 'C'-like shape so as to receive the edges of the base plate 200 thereinto, and generally, the number of clips 400 is three or more. The clips 400 are disposed along the edges of the base plate 200 and the slip plate 300 at predetermined intervals. The clips 400 should have appropriate size and strength of the material so as to exert a sufficient tensile force capable of supporting wind load moment.

The fixing bolts 410 are fastened to female screws passed through the top end portions of the clips 400 so as to compressedly support the top surface of the slip plate 300, thereby preventing the slip plate 300 from being separated from the base plate 200 by the application of wind load. Further, the fixing bolts 410 serve to fix the clips 300 to the base plate 200.

As shown in FIG. 3, if the fixing bolts 410 are fastened to the clips 400 in the state where the edges of the base plate 200 and the slip plate 300 are received into the inside of the clips 400, the base plate 200 and the slip plate 300 disposed between the fixing bolts 410 and the lower end portion of the clips 400 are compressed such that the slip plate 300 is fixedly disposed on the top surface of the base plate 200.

Figure 8:
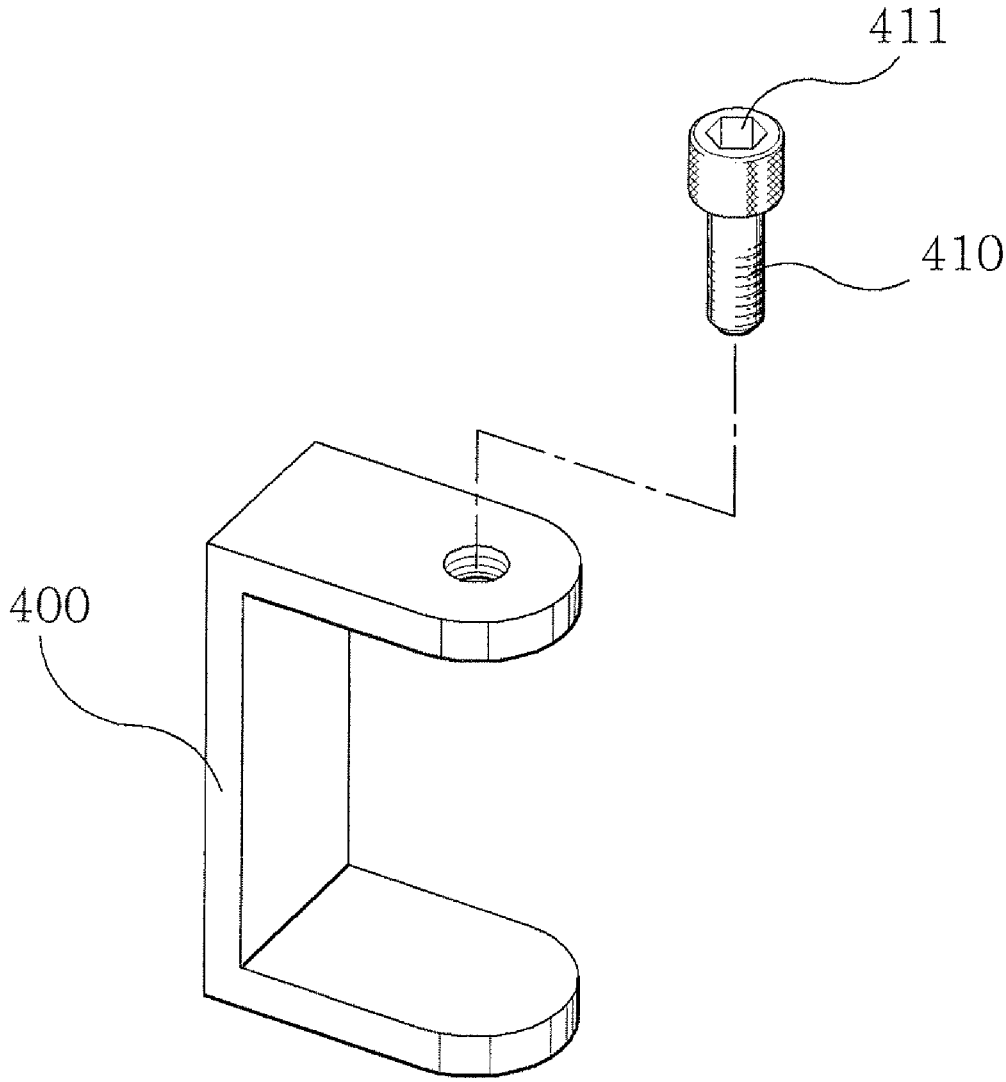
FIG. 8 is an enlarged view showing a clip and a fixing bolt.

As shown in FIG. 8, as the fixing bolt 410 is fastened to the clip 400, the top end portion of the clip 400 is finely opened from the lower end portion thereof, thereby generating tension (elastic force) therebetween. The generation of the tension prevents the fixing bolt 410 from being loose and at the same time allows the base plate 200 and the slip plate 300 to be fixedly fastened to each other through an appropriate force applied thereto.

Therefore, in normal cases the coupling relation between the slip plate 300 coupled integrally to the support body 100 and the base plate 200 fixed on the ground is stably maintained, and in some cases where impact load caused by the occurrence of the collision against a vehicle is more than a predetermined value, the slip plate 300 separably slips from the base plate 200, thereby minimizing the damages of the vehicle and the support body 100.

The fixing bolt 410 may be formed of a hex bolt having a generally hexagonal head portion, and as shown in FIG. 8, the fixing bolt 410 has a wrench-receiving portion 411 formed on the top surface of a round head portion, the wrench-receiving portion 411 being concave to a hexagonal shape. In this case, generally, the fixing bolt 410 is fastened to the clip 400 by means of a hex wrench, but it is not necessary to form the section of the wrench-receiving portion 411 to the hexagonal shape. That is, the wrench-receiving portion 411 may be formed to a square or other polygonal shapes. In this case, the wrench having the corresponding sectional shape to the wrench-receiving portion 411 is used to fasten the fixing bolt 410 to the clip 400.

FIGS. 4 and 5 show the second embodiment of the present invention, wherein the explanation on the same parts as in the first embodiment of the present invention will be avoided and the explanation on the different parts will be given.

According to the second embodiment of the present invention, the lower roller-receiving grooves 210 are formed spaced apart from each other on the top surface of the base plate 200 along the direction of length of the base plate 200, each having an arc-shaped section, and the upper roller-receiving grooves 310 are formed spaced apart from each other on the underside surface of the slip plate 300 to correspond with the lower roller-receiving grooves 210, each having an arc-shaped section.

Thus, when the base plate 200 and the slip plate 300 are coupled to each other, the lower roller-receiving grooves 210 and the upper roller-receiving grooves 310 form cylindrical space portions into which the cylindrical slip rollers 500 are inserted.

In addition to the fixing through the clips 400, when the slip rollers 500 are mounted, the sectional structure is made as shown in FIG. 5, such that in normal cases the coupling relation between the slip plate 300 and the base plate 200 is stably maintained and in the case where the collision against the vehicle occurs the slip plate 300 is slidingly moved along the slip rollers and smoothly separated from the base plate 200.

FIGS. 6, 7A and 7B show the third embodiment of the present invention, wherein the explanation on the same parts as in the second embodiment of the present invention will be avoided and the explanation on the different parts will be given.

The third embodiment of the present invention is almost same as the second embodiment of the present invention, except that the slip rollers 500 are replaced with the taper rollers 600.

That is, in the same manner as the second embodiment of the present invention, the lower roller-receiving grooves 210 and the upper roller-receiving grooves 310 form cylindrical space portions into which the taper rollers 600 each having a taper pin-like shape are inserted.

According to the insertion depths of the taper rollers 600, the slip plate 300 placed on the top surface of the base plate 200 is adjusted in height, such that the horizontal inclination of the slip plate 300 is controlled to allow the support body 100 to be erected.

In other words, as the taper rollers 600 are deeply inserted into the inside space portions between the upper roller-receiving grooves 310 and the lower roller-receiving grooves 210, the height of the slip plate 300 becomes high (which causes the distance between the top surface of the slip plate 300 and the underside surface of the base plate 300 to be long), and contrarily, as the lengths of the taper rollers 600 exposed to the outside are long, the height of the slip plate 300 becomes low.

Accordingly, as shown in FIG. 6, as the insertion lengths of the taper rollers 600 into the four side edges of the slip plate 300 are adjusted, the horizontal inclination of the slip plate 300 is adjusted, which permits the vertical inclination of the support body 100 coupled integrally to the slip plate 300 to be adjusted, thereby erecting the support body 100.

As described above, the structure for supporting the road support according to the present invention can maintain a stable coupling state between the slip plate to which the support body is coupled integrally and the base plate fixed on the ground in normal states during which wind load is applied, while separating the slip plate from the base plate in a state where external impact over a predetermined level caused by the collision against a vehicle is applied to the road support.

In other words, the structure for supporting the road support according to the present invention can maintain the stable coupling state between the slip plate and the base plate by means of the fastening of the clips effectively resisting the wind load applied to the road signs and the road support in normal states, and can separate the slip plate from the base plate, while appropriately absorbing the impact load applied to the road support in the state where vehicle collision occurs, thereby minimizing the damage of the vehicle and improving the safety of the passengers in the vehicle.

Additionally, the structure for supporting the road support according to the present invention can easily adjust the inclination of the slip plate so as to erect the support body.

In other words, since the taper rollers insertedly disposed at three or four edges of the slip plate are adjusted in the lengths of the insertion into the slip plate, the horizontal inclination of the slip plate can be adjusted.

The structure for supporting the road support according to the present invention can effectively absorb impact load applied thereto, thereby minimizing the damages of a vehicle and a driver and at the same time reducing the damage of a support body to increase the recycling effect of the support body.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A structure for supporting a road support, the structure comprising:

a base plate fixedly disposed on ground in such a manner as to be spaced apart by a predetermined distance from the surface of ground;

a slip plate slidably disposed on the top surface of the base plate;

a coupling body protruded upwardly from the center portion of the top surface of the slip plate in such a manner as to be insertedly coupled to the inner lower end portion of a support body; and a plurality of clips each having an approximately '⊏' or 'C'-like shape so as to receive the edges of the base plate and the slip plate thereinto, each of the plurality of clips having a fixing bolt fastened to a female screw passed through the top end portion thereof so as to compressedly support the top surface of the slip plate;

lower roller-receiving grooves formed spaced apart from each other on the top surface of the base plate along the direction of length of the base plate, each of the lower roller-receiving grooves having an arc-shaped section;

upper roller-receiving grooves formed spaced apart from each other on the underside surface of the slip plate to correspond with the lower roller-receiving grooves, each of the upper roller-receiving grooves having an arc-shaped section; and cylindrical slip rollers adapted to be inserted into space portions formed between the lower roller-receiving grooves and the upper roller-receiving grooves by the coupling of the base plate and the slip plate.

2. The structure for supporting a road support according to claim 1, wherein the fixing bolt has a wrench-receiving portion formed on the top surface thereof, the wrench-receiving portion being concave to a shape of a polygonal section so as to insert a wrench thereinto.

3. A structure for supporting a road support, the structure comprising:

a base plate fixedly disposed on ground in such a manner as to be spaced apart by a predetermined distance from the surface of ground;

a slip plate slidably disposed on the top surface of the base plate;

a coupling body protruded upwardly from the center portion of the top surface of the slip plate in such a manner as to be insertedly coupled to the inner lower end portion of a support body;

a plurality of clips each having an approximately '⊏' or 'C'-like shape so as to receive the edges of the base plate and the slip plate thereinto, each of the plurality of clips having a fixing bolt fastened to a female screw passed through the top end portion thereof so as to compressedly support the top surface of the slip plate;

lower roller-receiving grooves formed spaced apart from each other on the top surface of the base plate along the direction of length of the base plate, each of the lower roller-receiving grooves having an arc-shaped section;

upper roller-receiving grooves formed spaced apart from each other on the underside surface of the slip plate to correspond with the lower roller-receiving grooves, each of the upper roller-receiving grooves having an arc-shaped section; and taper rollers each having a taper pin-like shape adapted to be inserted into space portions formed between the lower roller-receiving grooves and the upper roller-receiving grooves by the coupling of the base plate and the slip plate.

4. The structure for supporting a road support according to claim 3, wherein the fixing bolt has a wrench-receiving portion formed on the top surface thereof, the wrench-receiving portion being concave to a shape of a polygonal section so as to insert a wrench thereinto.

* * * * *